US010267099B2

(12) United States Patent
Mailand

(10) Patent No.: US 10,267,099 B2
(45) Date of Patent: Apr. 23, 2019

(54) ISOLATION SLEEVE FOR DOWNHOLE EQUIPMENT

(71) Applicant: Tejas Research & Engineering, LLC, The Woodlands, TX (US)

(72) Inventor: Jason C. Mailand, The Woodlands, TX (US)

(73) Assignee: Tejas Research & Engineering, LLC, The Woodlands, TX (US)

( * ) Notice: Subject to any disclaimer, the term of this patent is extended or adjusted under 35 U.S.C. 154(b) by 443 days.

(21) Appl. No.: 15/062,536

(22) Filed: Mar. 7, 2016

(65) Prior Publication Data

US 2017/0254157 A1 Sep. 7, 2017

(51) Int. Cl.
*E21B 17/10* (2006.01)
*E21B 34/06* (2006.01)

(52) U.S. Cl.
CPC ..... *E21B 17/10* (2013.01); *E21B 34/06* (2013.01)

(58) Field of Classification Search
CPC ..... E21B 17/10
USPC ..... 166/243
See application file for complete search history.

(56) References Cited

U.S. PATENT DOCUMENTS 7,624,799 B2 * 12/2009 Myhre ..... E21B 17/1007 166/242.1
9,016,388 B2 * 4/2015 Kellner ..... E21B 34/063 166/386
10,030,472 B2 * 7/2018 Fripp ..... E21B 43/12
2009/0314492 A1 * 12/2009 Reid ..... E21B 17/1007 166/298
2013/0105175 A1 * 5/2013 Mailand ..... E21B 34/06 166/373

* cited by examiner

*Primary Examiner* — Taras P Bemko
(74) *Attorney, Agent, or Firm* — Basil M. Angelo; Angelo IP

(57) ABSTRACT

A protective sleeve is deployable within an oil/gas well to protect a device installed in the well such as a safety valve, for example. The sleeve includes a pressure equalizing dart and an overpressure protection piston. The sleeve also serves to isolate an installed device from harmful substances such as acids and other corrosive fluids.

3 Claims, 7 Drawing Sheets

ISOLATION SLEEVE FOR DOWNHOLE EQUIPMENT

BACKGROUND OF THE INVENTION

1. Field of the Invention

This invention relates to downhole mechanical devices. More particularly a protective sleeve is provided for use on a tubular passing through an installed device, such as a downhole safety valve, to prevent damage to the installed device by the tubular when well operations are performed below the installed device. Also, the protective sleeve is provided for pressure protection of critical components within an installed device and for preventing potentially damaging fluids from making contact with critical components and seals within an installed device, such as a downhole safety valve.

2. Description of Related Arts

A variety of equipment is commonly installed in tubing strings in wells. One common type of equipment is a downhole safety valve. Other types include sliding sleeves that can be shifted to open or close conduits to allow fluid to enter or exit the tubing. It is common in well operations to pass smaller tubing, which may be coiled tubing, through the well tubing and through the installed equipment. The smaller tubing, which may be a work string, may be used for conveying fluid into or out of the well or for other well operations.

The smaller tubing slides through downhole equipment in the tubing, but in some cases it has been found that the smaller tubing may cause damage to the downhole equipment. Damage to a downhole safety valve, for example, can create hazardous conditions or can cause very expensive repair operations. There is a clear need for method and apparatus to protect installed downhole equipment from effects of passage of tubulars through the equipment.

BRIEF SUMMARY OF THE INVENTION

A protective sleeve that is deployed on the bottom of tubing and is retained in a downhole installed device having a matching locking mechanism is provided. The sleeve may be retained at the selected position in the downhole equipment by shearing of pins between the sleeve and a mandrel. The sleeve may then be retrieved by withdrawing the tubing through the device. The sleeve may include an over pressure balancing mechanism which is operable at any time and a pressure equalization feature which is actuated during recovery. The sleeve protects installed devices from potentially high pressures during fracturing. It also isolates the installed devices from acids and other damaging fluids within the well.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
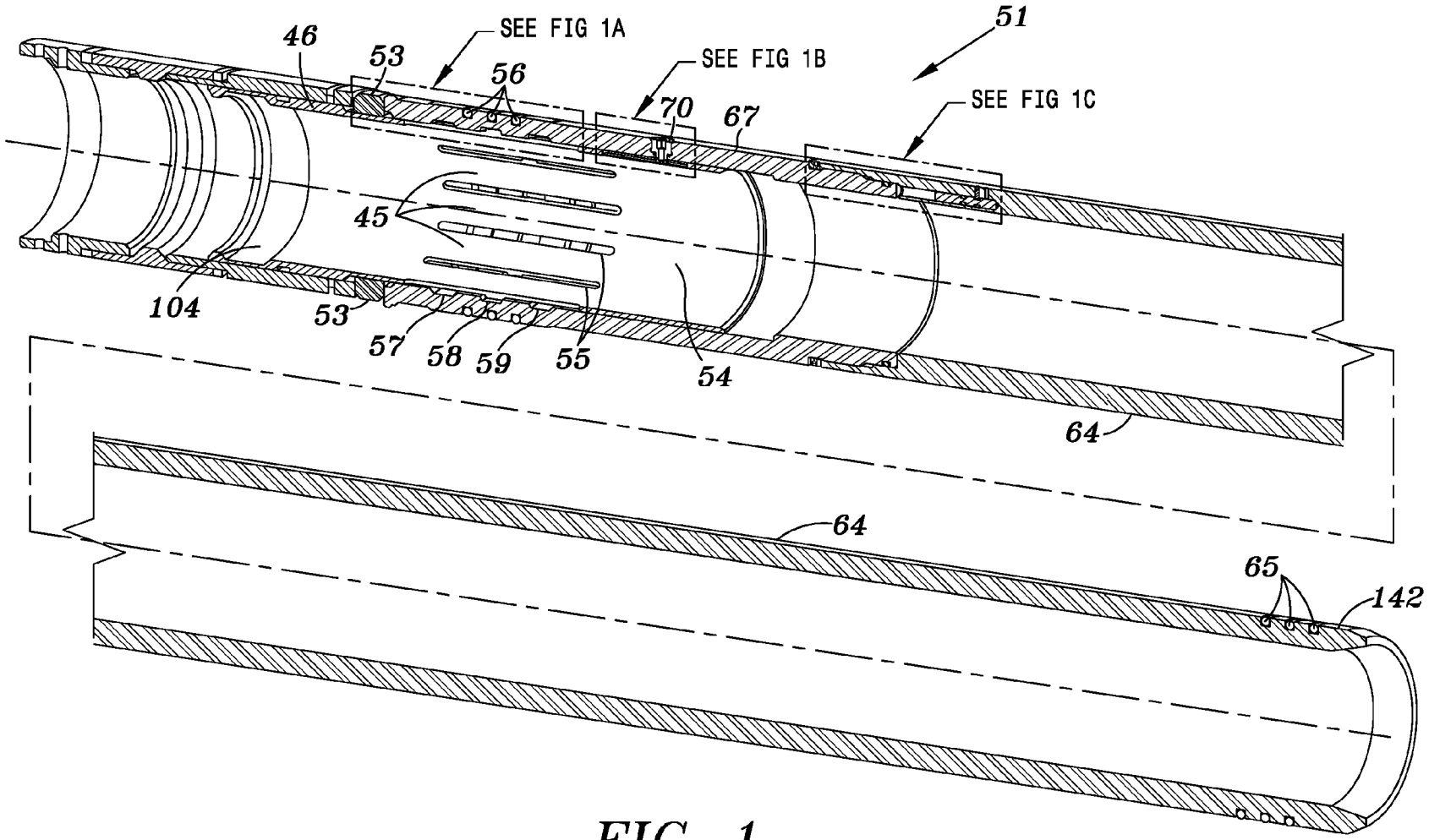
FIG. 1 is a cross-sectional view of a first embodiment of the invention

Referring to FIGS. 1-11 an embodiment of a protective sleeve according to the invention is disclosed. The protection sleeve 51 includes a locking collet housing portion 67 in which locking collet 54 is slidably mounted. Collet housing 67 is attached to a downstream housing 64 which serves as a protective sleeve for the installed device, and includes a plurality of seals 65 on an outer surface 142 of its lower portion. Collet housing 67 and main housing 64 are cylindrical in shape and are tubular so as to provide an interior passageway for either fluids or other tubular equipment.

Locking collet 54 includes a plurality of slots 55 that form finger like portions 45. A plurality of radically spaced ridges 49 as shown in FIG. 1A are formed on the outer surface of fingers 45 to form a collet in a manner known in the art.

Locking collet 54 also includes a profile annular groove 104 on an inside surface as shown in FIG. 1. Locking collet further includes an annular ridge or raised portion 46 on its outer surface, and an axially extending slot 47 on its other surface as shown in FIG. 1B.

Figure 1A:
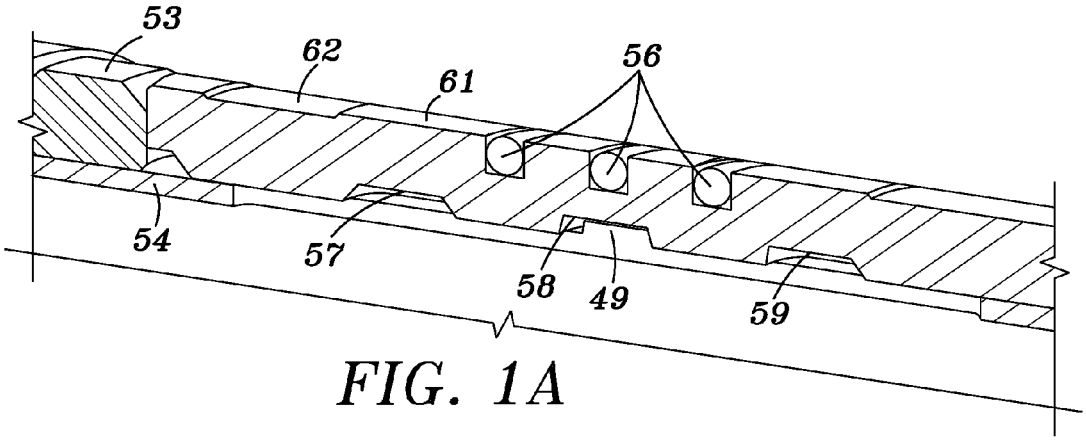
FIG. 1A is a detailed blow up view of the indicated portion of FIG. 1.

Locking collet housing 67 includes a plurality of interior annual groves 57, 58, and 59 as best shown in FIG. 1A and a plurality of annular seals 56 on a raised surface 61. A plurality of locking dogs 53 are positioned within openings provided in the locking collet housing and engage collet 54 at a first, non-locking position shown in FIG. 1.

Figure 8:
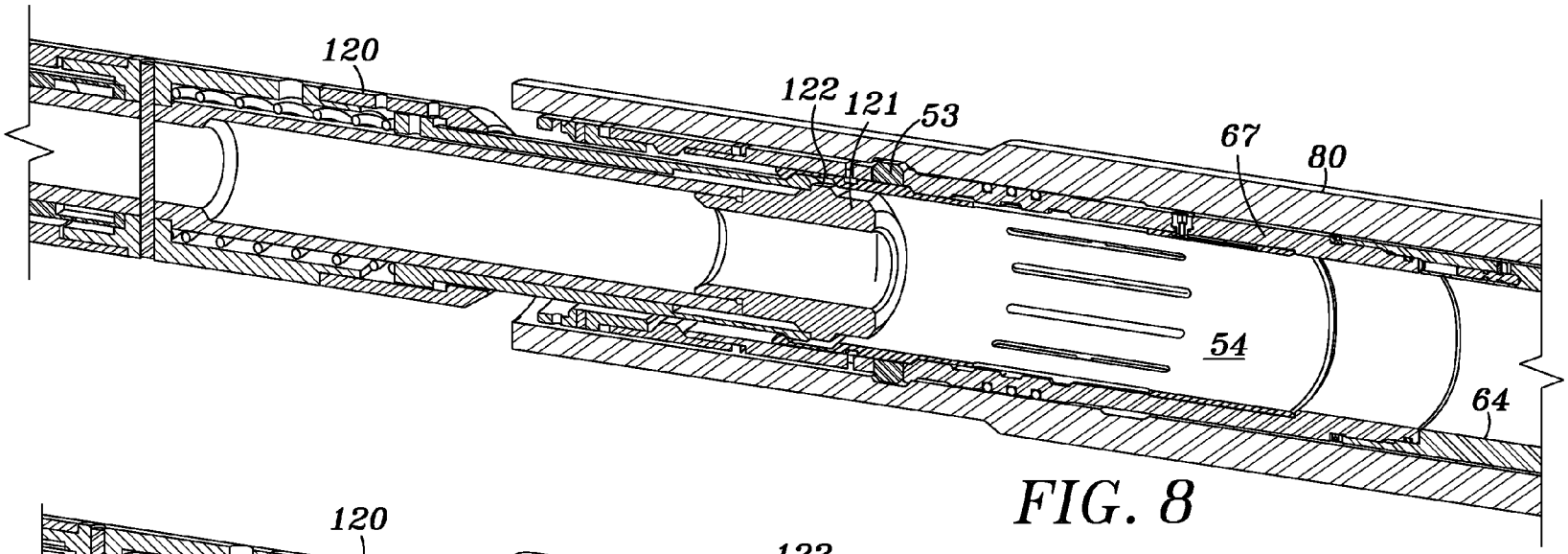
FIG. 8 is a cross-sectional view of the pulling tool as it initially is pulled to engage the sleeve.
Figure 9:
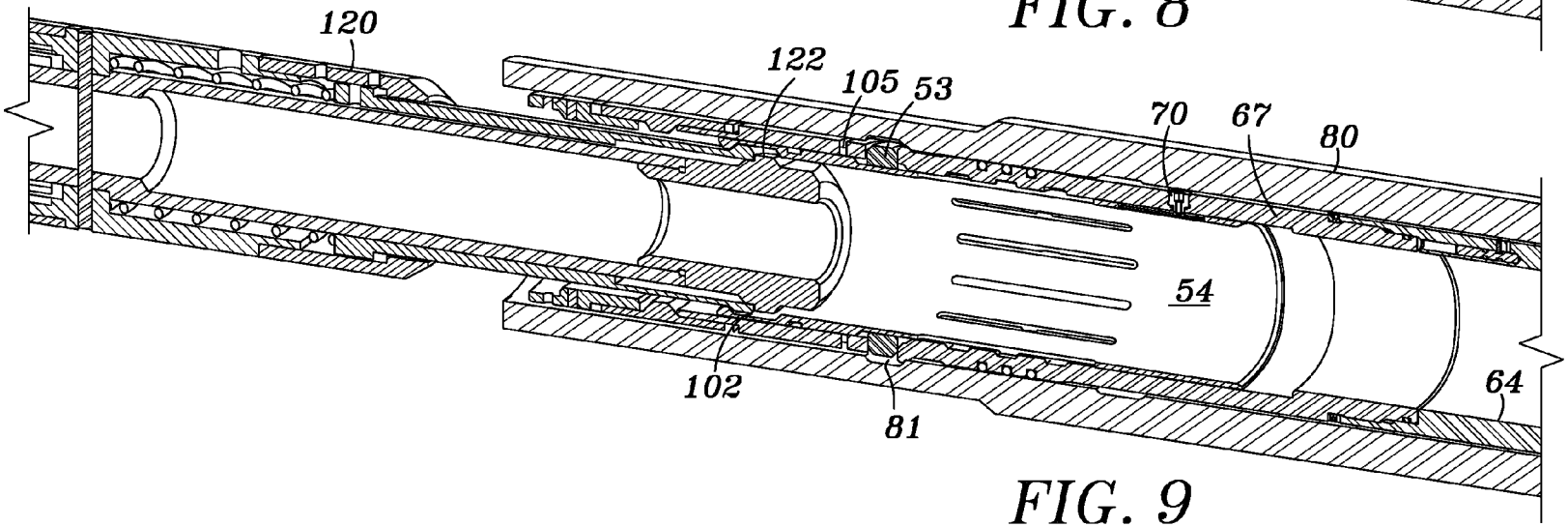
FIG. 9 is a cross-sectional view of the pulling tool after being jarred up to shear the sleeve release pins.

Locking dogs 53 are adapted to be moved in a radial direction into a groove 81 on the interior surface of the safety valve 80 as best shown in FIGS. 8 and 9.

Figure 1B:
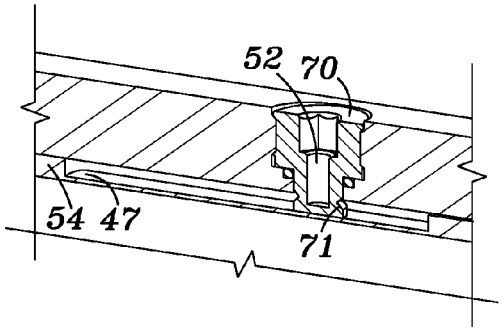
FIG. 1B is a detailed blow-up view of the indicated portion of FIG. 1.

Locking collet housing 67 also includes a frangible pressure equalizing dart 70 having a frangible portion 71 that is positioned within slot 47 of the locking collet as shown in FIG. 1B. Dart 70 also includes a flow passage 52. A no-go shoulder 77 is formed on the outer surface of locking collet housing 67 and prevents further downhole movement of the protective sleeve within safety valve housing 80.

Figure 1C:
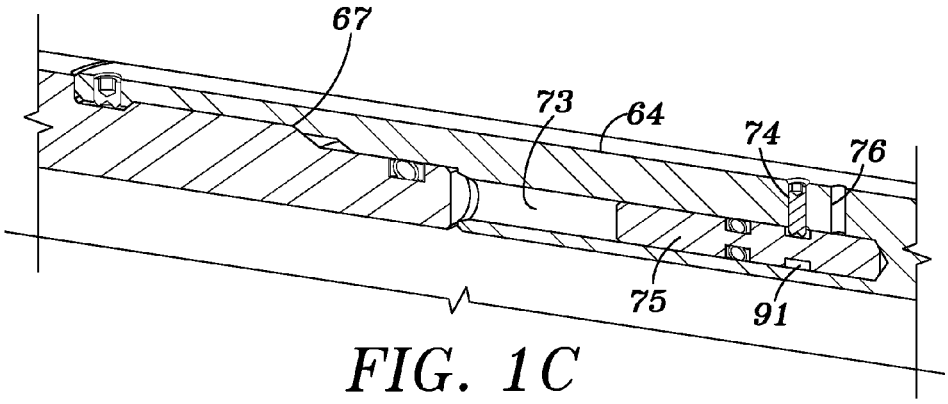
FIG. 1C is a detailed blow-up view of the indicated portion of FIG. 1.

As shown in FIG. 1C, downstream housing 64 includes a pressure balancing chamber 73 in which a floating piston 75 is positioned. A shear pin 74 engages a groove 91 in piston 75 and initially prevents movement of the piston within chamber 73.

Figure 2:
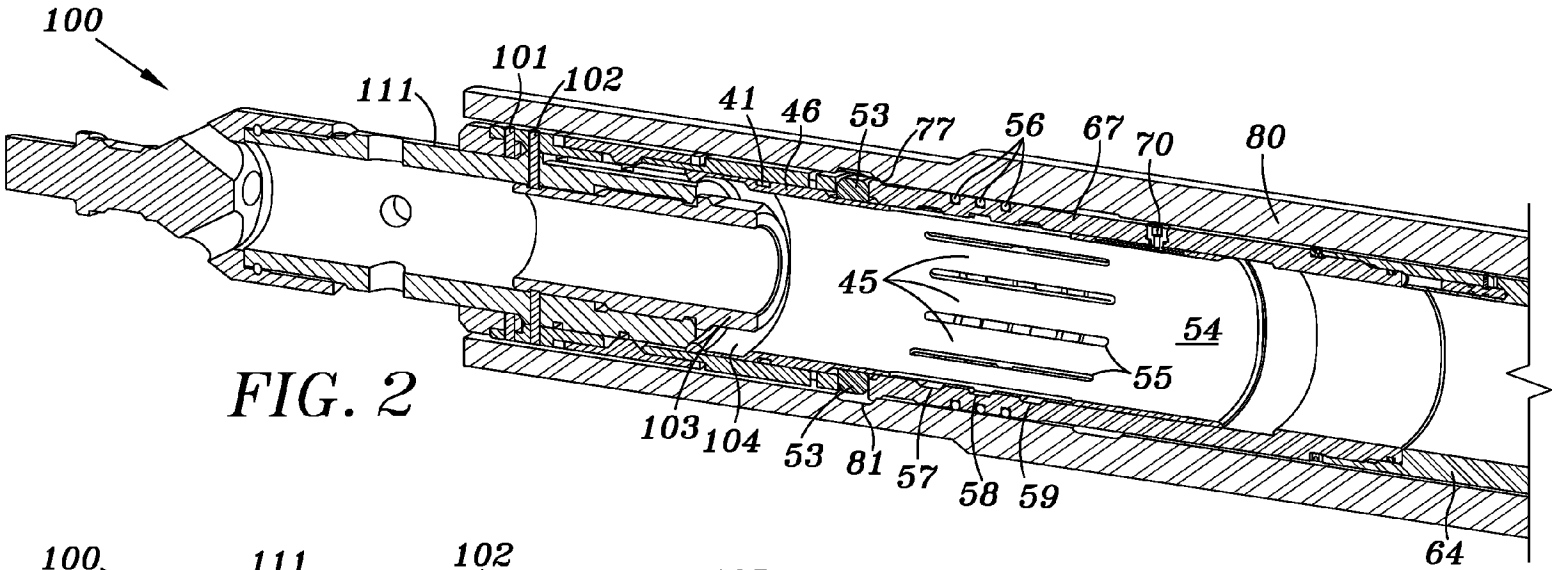
FIG. 2 is a cross-sectional view of a setting tool and the protective sleeve in the pre-set position within a safety valve.

As shown in FIG. 2, a running tool 100 including a body portion 111 and a top portion 103 is utilized to set the protective sleeve 51 within safety valve housing 80. The running tool 100 is a Z running tool, known in the industry but slightly modified. Running tool 100 includes a first shear pin 101 and a second shear pin 102 as shown in FIG. 2.

Figure 3:
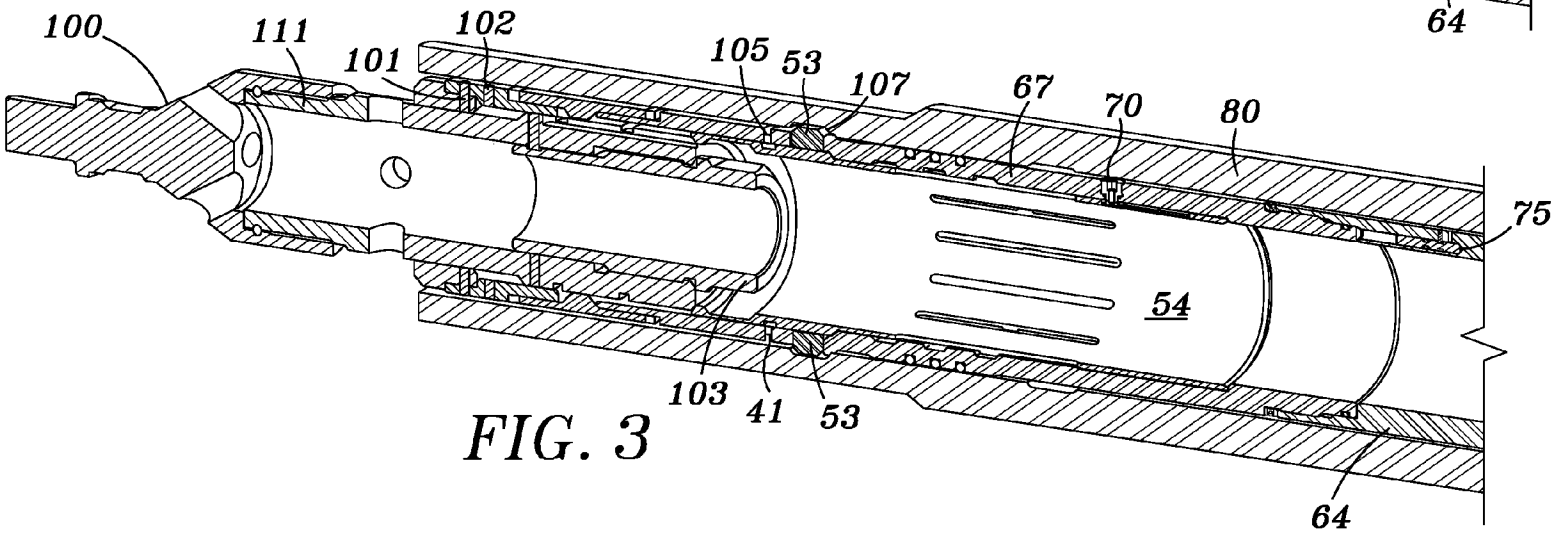
FIG. 3 is a cross-sectional view of a running tool and sleeve positioned within a safety valve in the set position.

As the running tool is moved downhole as shown in FIG. 3 pins 102 are sheared and, locking dogs 53 are moved radically outwardly by shoulder 46 into groove 81 and retrieval shear screws 105 are engaged in a groove 41 on the outside surface of locking collet 54. The protection sleeve is now locked within safety valve housing 80, with ridges 49 now positioned within groove 59 of locking sleeve housing 67.

Figure 4:
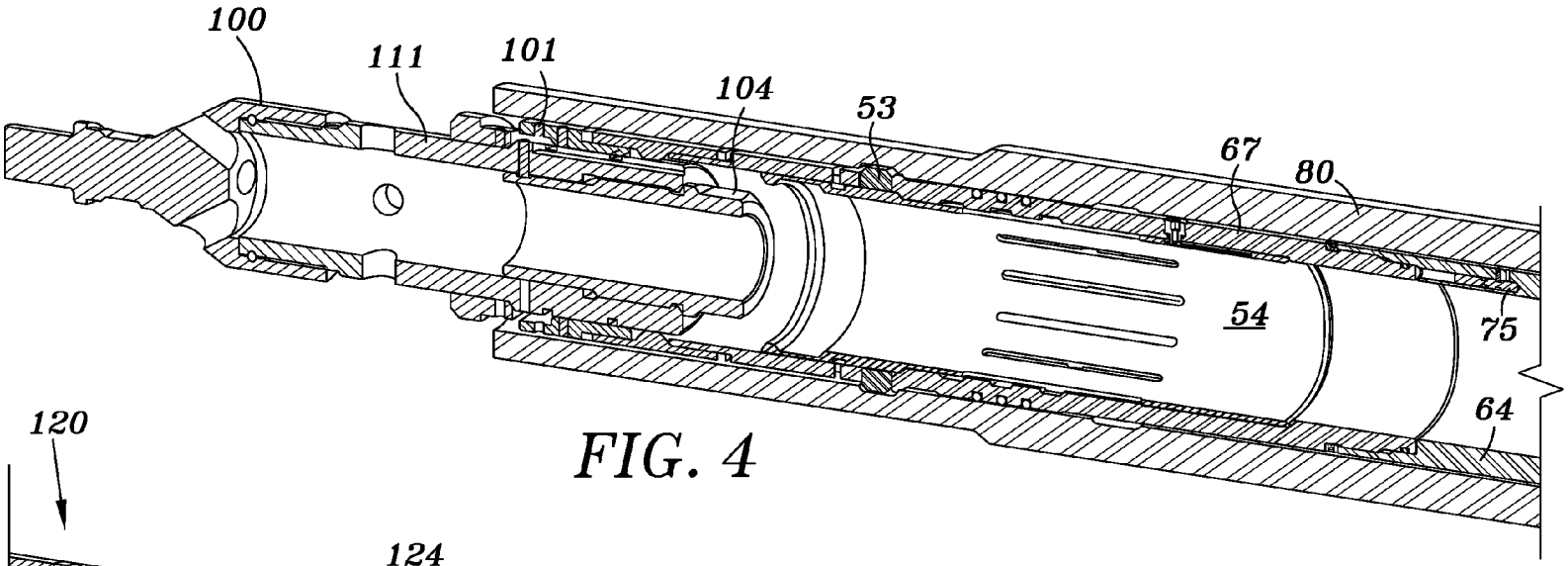
FIG. 4 is a cross-sectional view of the running tool and sleeve after jarring up to release the running tool.

As running tool 100 is removed from the locking collet as shown in FIG. 4, shear pin 101 is sheared thereby releasing the running tool 100 from housing 67.

Figure 5:
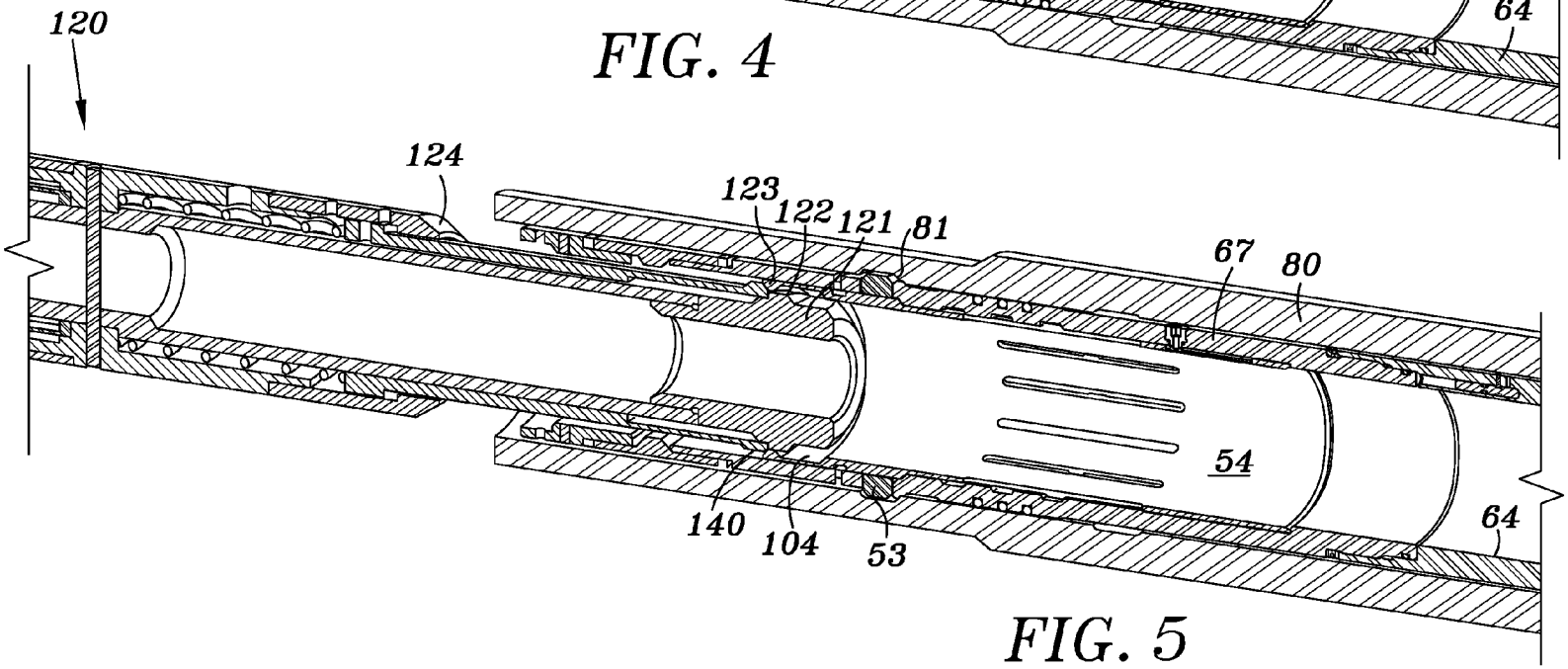
FIG. 5 is a cross-sectional view of a pulling tool positioned within the sleeve.
Figure 6:
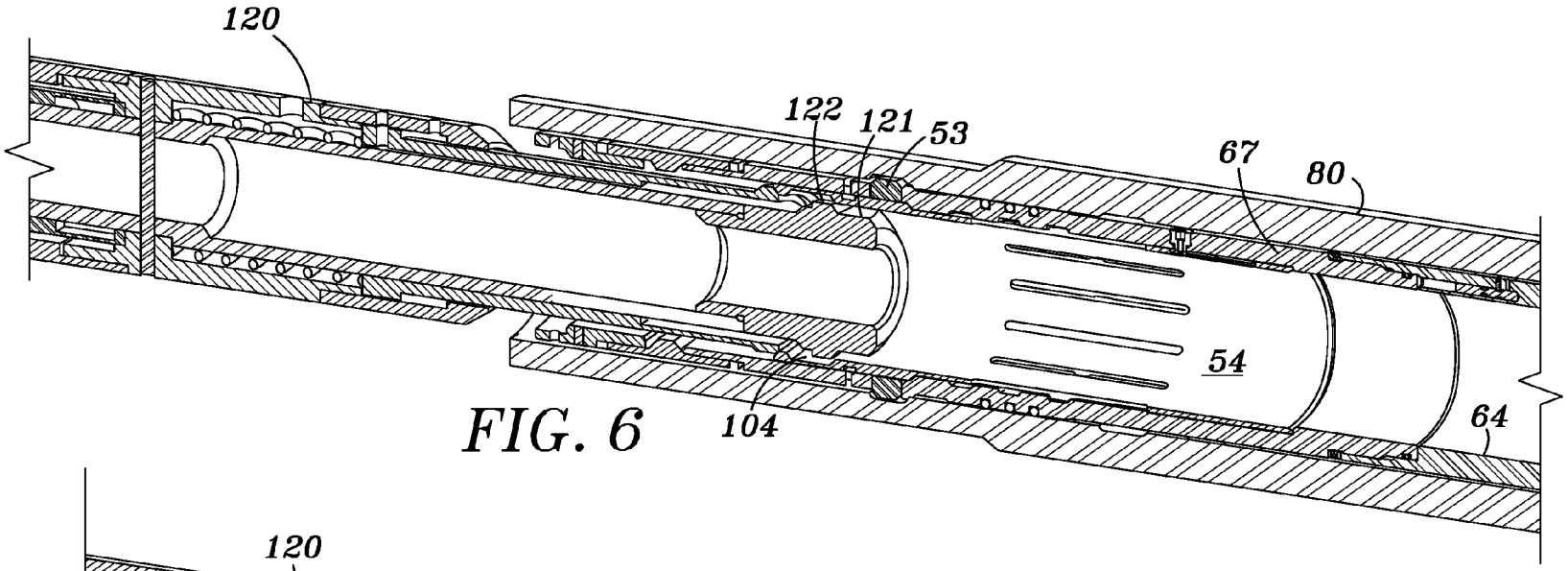
FIG. 6 is a cross-sectional view of the pulling tool at set down full weight.

In order to remove the sleeve from the safety valve housing, a pulling tool 120 is run to the set depth as shown in FIG. 5 with flange 122 of the pulling tool positioned as shown adjacent groove 104 in the locking collet. As the running tool is set down as shown in FIG. 6 flange 122 is positioned within groove 104 of the locking collet 59.

Figure 7:
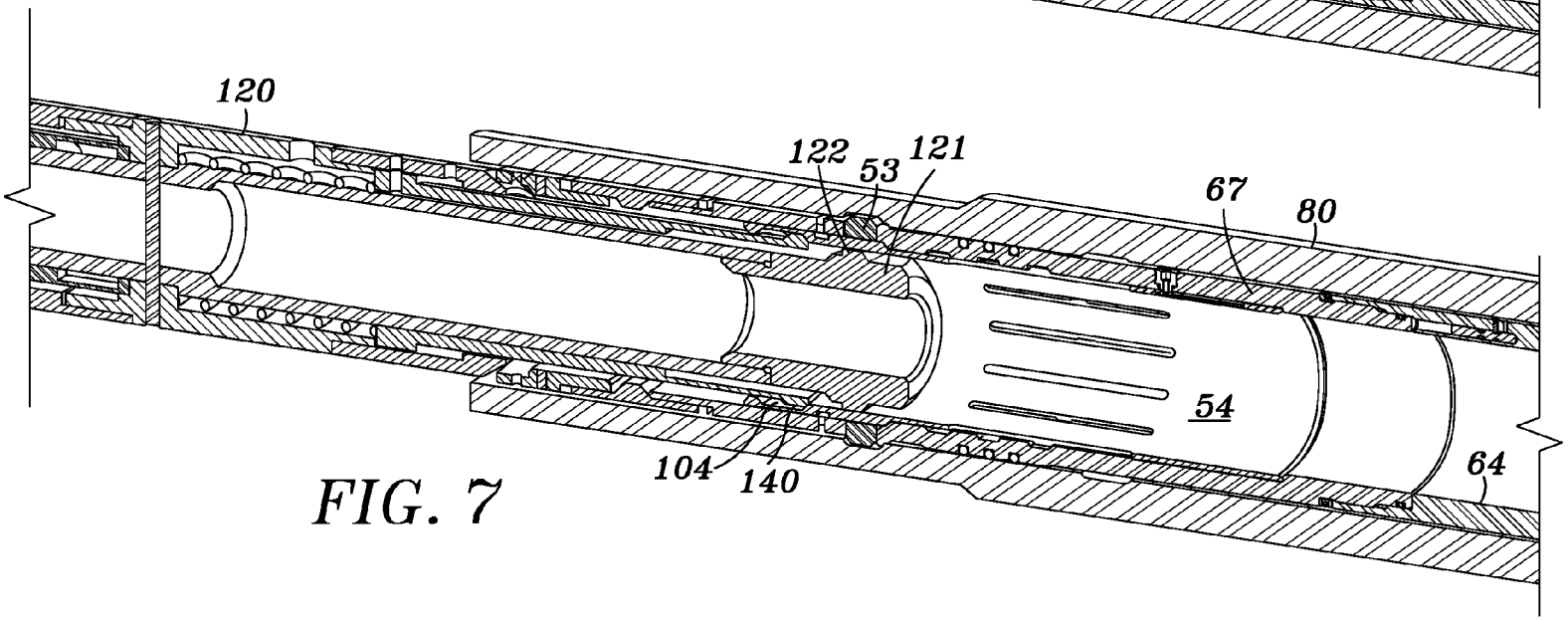
FIG. 7 is a cross-sectional view showing the pulling tool collet engaging the internal profile of the sleeve collet.

As the running tool is set down at full weigh shown in FIG. 7, collet fingers 140 of the pulling tool are positioned within groove 104 of the locking sleeve.

To remove the protective sleeve, the pulling tool 120 is pulled upward so that flange 122 moves into contact with collet finger 140 of the pulling tool. The pulling tool is jarred upwardly so that retrieval shear screws 105 are sheared and locking collet 54 moves upwardly to the position shown in FIG. 9, thereby allowing dogs 53 to move radially inwardly out of grove 81. Ridges 49 of the locking collet 54 are now engaged in groove 58.

Figure 10:
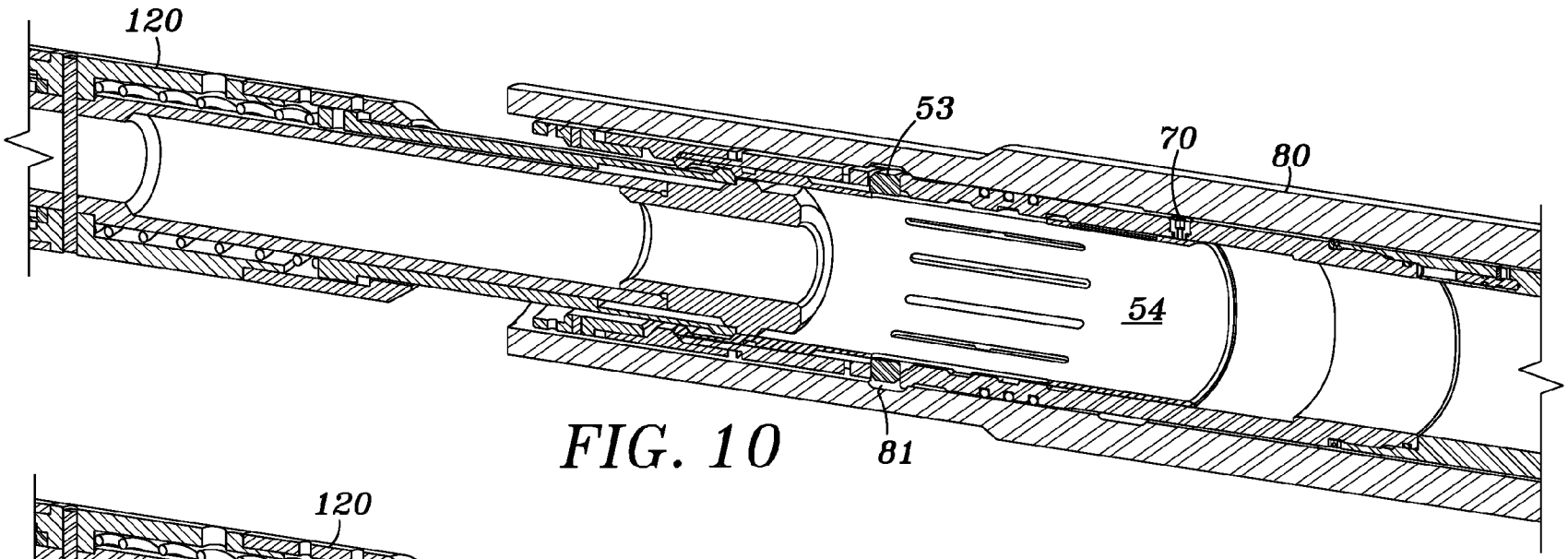
FIG. 10 is a cross-sectional view of the pulling tool after being jarred up further to shear the equalizing dart.
Figure 11:
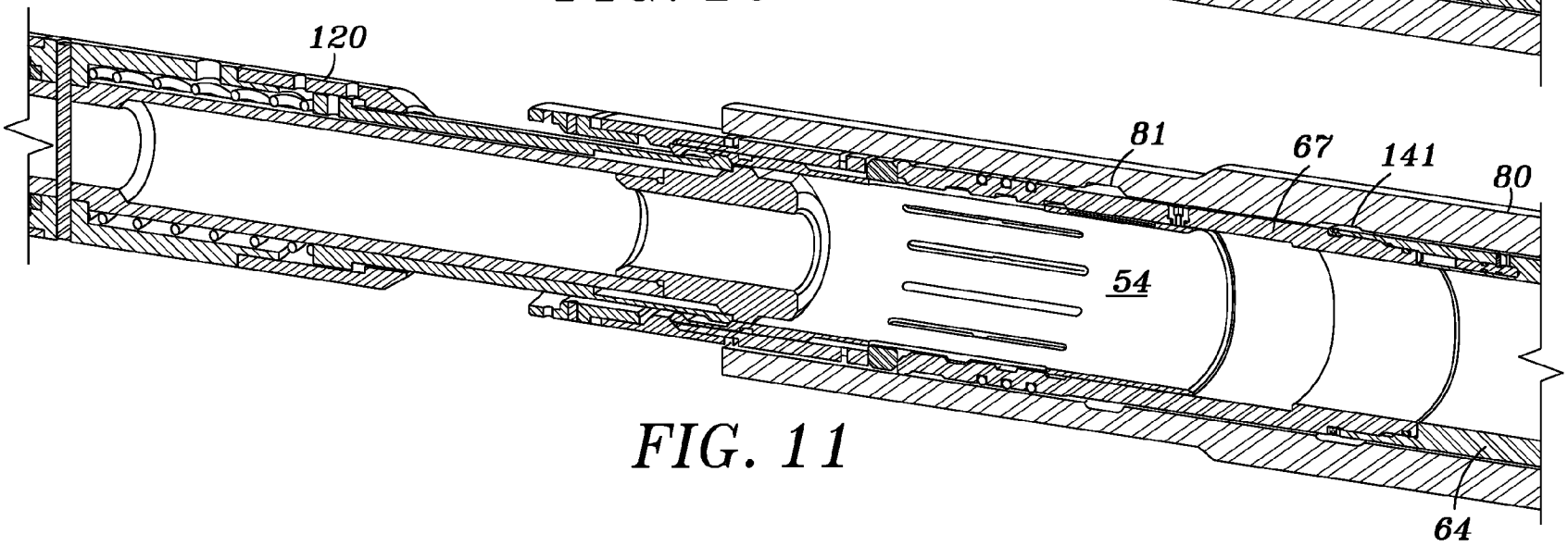
FIG. 11 is a cross-sectional view of the pulling tool pulling the protective sleeve out of the safety valve.

The pulling tool is next jarred upwardly again to the position showing FIG. 10. This will sever equalizing dart 70 thereby equalizing the pressure on the inside and outside of the main housing of the protective sleeve. At this point, the pulling tool can be pulled in an upward direction to remove the protective sleeve from the safety valve housing as shown in FIG. 11. Ridges 49 of locking collet 54 are now positioned within grove 57.

Should the pressure differential between the inside and outside of the protective sleeve become too great at any time, shear pin 74 will fail and piston 75 can float within chamber 73 thereby balancing the pressure via port 76.

Although the present invention and its advantages have been described in detail, it should be understood that various changes, substitutions and alterations may be made herein without departing from the spirit and scope of the invention as defined by the appended claims.

What is claimed is:

1. A protective sleeve adapted to be secured within a well for protecting a device positioned within the well comprising:

a) a housing including a collet housing and a downstream housing, b) a locking collet slidably received in said collet housing and c) a pressure equalizing dart located in a wall of the housing and having a flow passage closed at an end by a frangible member, said frangible member being severed by upward movement of the locking collet as the protective sleeve is withdrawn from the well.

2. The protective sleeve of claim 1 wherein the locking collet has a slot adapted to receive the frangible member of the pressure equalizing dart.

3. The protective sleeve of claim 1 wherein the housing further includes a pressure balancing chamber and a floating piston within the chamber.

* * * * *